US005720819A

United States Patent [19]

Puls

[11] Patent Number: 5,720,819

[45] Date of Patent: Feb. 24, 1998

[54] ELECTROSTATIC LIQUID APPLICATOR FOR SPRAYING A LIQUID SURFACE-COATING MATERIAL

[75] Inventor: Lawrence V. Puls, Corona, Calif.

[73] Assignee: Northrop Grumman Corporation, Los Angeles, Calif.

[21] Appl. No.: 633,594

[22] Filed: Apr. 17, 1996

[51] Int. Cl.[6] ..... B05B 5/025; B05C 5/02

[52] U.S. Cl. ..... 118/621; 118/629; 239/690; 239/699; 239/700

[58] Field of Search ..... 118/621, 629; 239/690, 699, 700

[56] References Cited

U.S. PATENT DOCUMENTS

| | | | |
|---|---|---|---|
| 2,911,323 | 11/1959 | France | 117/93 |
| 3,104,185 | 9/1963 | Reindl et al. | 118/627 |
| 3,418,971 | 12/1968 | Lamm | 118/626 |
| 3,442,688 | 5/1969 | Pettigrew | 117/93.4 |
| 4,601,921 | 7/1986 | Lee | 427/240 |

FOREIGN PATENT DOCUMENTS

| | | | |
|---|---|---|---|
| 422813 | 4/1991 | European Pat. Off. | 118/629 |
| 4340441 | 11/1993 | Germany | 118/629 |
| 2163675 | 3/1986 | United Kingdom | 239/700 |

*Primary Examiner*—Donald E. Czaja
*Assistant Examiner*—Michael P. Colaianni
*Attorney, Agent, or Firm*—Terry J. Anderson; Karl J. Hoch, Jr.

[57] ABSTRACT

An electrostatic liquid applicator; such as an oscillating disk paint gun, for spraying a liquid coating material such as paint or the like onto the surfaces of a wide variety of types of articles. The electrostatic liquid applicator includes a stationary bell, an oscillating drive shaft extending through the stationary bell and which is rotatably driven by an air-controlled drive system. An oscillating disk is fixedly mounted on the drive shaft towards the front side of the stationary bell so as to form a spray slot in a liquid plenum in cooperation with the front side of the stationary bell. The drive system includes a body portion which is located at the rear side of the stationary bell, and includes air supply ports and air exhaust ports and forms a sealed space with the rear side of the stationary bell. A drive member projects radially into this space and is anchored to the drive shaft for pivoting the latter between two end positions which are defined within a predetermined angle.

10 Claims, 2 Drawing Sheets

ELECTROSTATIC LIQUID APPLICATOR FOR SPRAYING A LIQUID SURFACE-COATING MATERIAL

BACKGROUND OF THE INVENTION

1. Field of the Invention

The present invention relates to an electrostatic liquid applicator; such as an oscillating disk paint gun, for spraying a liquid coating material such as paint or the like onto the surfaces of a wide variety of types of articles.

Various methods for the atomization of liquid coating or paint materials are used for the purpose of implementing electrostatic liquid applications such as for electrostatic painting in diverse sectors of industry. Virtually all of the atomization methods rely on mechanical forces for breaking or fragmenting the liquid into fine droplets. The electrostatic concept primarily resides in imparting an electrical charge to the liquid droplets in order to cause them to be physically attracted to the article which is to be coated or painted with the coating material. The atomization methods must be carefully controlled so as to maintain the available high transfer efficiencies available, and an optimization of the electrostatic transfer efficiencies can only be attained in the event that the electrical potential is actually the force which causes the atomization of the liquid coating material or paint. This optimization can be readily achieved by presenting the coating liquid or paint in the form of small beads at a location of a corona discharge. The beads will be torn off or pulled from the surface in the form of fine, highly-charged droplets, whereby each of the droplets repels each other droplet due to their like polar electrical charges. Inasmuch as the article which is to be painted possesses the same potential as the grounded leg of the charging electrical power source, it carries a charge of a polarity opposite that of the charged liquid particles. Consequently, the liquid will, therefore, be strongly physically attracted to the article which is to be coated or painted with the liquid particles.

2. Discussion of the Prior Art

An electrostatic liquid paint applicator has become known in the paint spraying technology, which utilizes the above-described principle as its primary or single factor in atomizing the paint, and wherein this liquid paint applicator is capable of maintaining transfer efficiencies within the range of about 97 to 99%. A basic applicator system of this type was initially developed by the General Motors Corporation, Detroit, Mich. during the 1950s.

The applicator generally incorporates a stationary housing or bell, an oscillation drive shaft and an oscillating disk. The oscillation drive shaft extends through the stationary bell and is rotatably driven by a pressurized air-controlled drive system. The oscillating disk is fixedly mounted to the drive shaft at the front side of the stationary bell so that a spray slot is formed between the outer diameter of the oscillating disk and the inner diameter of a sidewall of the stationary bell. Furthermore, a liquid plenum is formed between the rear side of the oscillating disk and the front side of the stationary bell. In operation, paint is supplied at a low pressure/flow rate to the paint plenum through a paint entry port located in the body portion of the stationary bell. The plenum equalizes the pressure of the paint, thereby forcing it uniformly through the narrow spray slot between the oscillating disk and the stationary bell. With the pressure acting on the paint, the latter slowly exudes through a spray slot which is present between the sharp edges of the disk and the bell. In the absence of an application of the high voltage electric potential, the paint will merely drip down; however, when a high voltage electric potential is applied to the paint applicator and the article which is to be painted has a common ground as the power source, these sharp edges face the article and, therefore, concentrate the charge, resultingly creating a corona. The corona ionizes the air and imparts an electric potential to the paint exuding from the spray slot, causing paint to be electrostatically atomized into fine droplets which, due to their common or of the same polarity electrical charge repel each other and disperse while at the same time, the droplets are strongly attracted to the grounded article. The average size of the droplets is a function of the paint viscosity, its flow rate, the spray slot cross-section and the voltage applied to the paint applicator.

The oscillation of the disk maintains a uniform paint flow through the narrow paint slot. The disk has a series of pads on its outer diameter which bridge the spray slot so as to contact the inner diameter of the=sidewall of the stationary bell, while the sidewall of the stationary bell is provided with a mating series of pads on the inner diameter thereof. With each oscillation of the disk each of its pads wipe the inner diameter of the stationary bell over the distance between two of its adjacent pads, whereas each pad on the stationary bell wipes the outer diameter of the oscillating disk as it passes by over the distance between two of its adjacent pads. The resultant wiping action maintains the spray slot free from any accumulation of any contaminants or debris which can obstruct the flow of paint. The oscillating disk is keyed to the oscillating drive shaft which is driven by an oscillating drive arm which, in turn is driven by a suitable air cylinder.

This above-described and presently known system evidences a high efficiency in the application of the paint and a very good long-term operating performance. The only essential servicing care required is to maintain the sharp edges of the paint discharge slots free from nicks and burrs inasmuch as irregularities encountered on these edges concentrate the corona discharge causing a discharge of the paint in the form of a constant stream. Any simple precautions taken in handling the spray guns during cleaning and operation will prevent damage to these areas of the equipment. In the event that the edges are damaged, minor grinding is usually all that is required to restore the edges to their original operationally adequate condition.

One of the problems encountered in the above-mentioned system is in the supplying of the paint. Individual positive displacement metering pumps were originally employed to control the paint flow from a manifold to each paint applicator. A friction wheel driven by contact with the face of a rotating disk powered each pump, and the rate of metering the supply flow was determined by the distance from the center of the disk to where the friction wheel engaged the disk surface. Seals on the pumps were subject to wear and, therefore, resulted in leakage, whereby any leakage of paint into the mechanism which controlled the location of the pump drive on the disk surface prevented the adjustment thereof. Wear of the pump allowed the paint supply manifold pressure to force the paint through the pump in the absence of any control.

In order to overcome these drawbacks, the paint supply was changed to a pressure-regulated paint feed control, such that with a stable fluid path, a regulated pressure drop would control the rate of flow. Utilizing a two-stage pressure reduction gave very precise control of the paint flow through each paint applicator. A fluid pressure regulator in the paint recirculation line reduced the pressure in the manifold supplying, for example, six guns or applicators, to 30 lbs. per square inch. Individual low pressure regulators for each applicator supplied the paint at pressures of from 2 to 5 psi as required to provide for the desired paint flow through each electrostatic paint applicator.

As mentioned above, the known system utilizes an air cylinder to oscillate the disk, in which the air cylinder displaces an arm which is keyed to a shaft to which the disk is fastened. The arm is spring loaded to return the disk and air cylinder into their original positions. The wipe rate in the air cylinder drive direction can be controlled through a pressure regulator on the air supply, and in order to vary the return rate it is necessary to change the spring tension, which cannot be effectuated during the painting operation. Therefore, the above-mentioned electrostatic paint applicator is subject to the drawback that, although the wipe rate of the oscillating disk can be controlled, the return rate is constant due to the fixed spring tension. To implement a variation or change in the spring tension, it is necessary to change the entire spring. Moreover, the spring tension can uncontrollably change due to encountered wear, dirt, material defects, temperature variations, and other conditions prevalent during operation of the electrostatic applicator.

Various methods and apparatuses for spraying coating materials, such as electrostatic spray devices and methods are disclosed, for example, in Lee U.S. Pat. No. 4,601,921; Pettigrew U.S. Pat. No. 3,442,688; Lamm U.S. Pat. No. 3,418,971; Reindl, et al. U.S. Pat. No. 3,104,185; and Prance U.S. Pat. No. 2,911,323.

However, although the foregoing all relate to various types of electrostatic spray devices for the application of coating materials onto surfaces, none of these disclose the simple device as described and disclosed herein.

SUMMARY OF THE INVENTION

Accordingly, it is an object of the present invention to provide an electrostatic liquid applicator which overcomes the limitations of the state of the art.

It is a further object of the invention to provide an electrostatic liquid applicator of the type described which possesses the ability to control not only the wipe rate of the oscillating disk, but also its return rate.

Still another object of the invention is to provide an electrostatic liquid applicator with an increased ability of the penetration of paint into difficultly accessible areas.

The electrostatic liquid applicator according to the invention comprises a stationary bell, an oscillating drive shaft extending through the stationary bell and which is rotatably driven by an air-controlled drive system. An oscillating disk is fixedly mounted on the drive shaft towards the front side of the stationary bell so as to form a spray slot in a liquid plenum in cooperation with the front side of the stationary bell. The drive system includes a body portion which is located at the rear side of the stationary bell, and includes air supply ports and air exhaust ports and forms a sealed space with the rear side of the stationary bell. A drive member projects radially into this space and is anchored to the drive shaft for pivoting the latter between two end positions which are defined within a predetermined angle. A plate member is located in the space between the body portion and the drive member, and includes openings and stop members extending into the space, with the plate member being movable between two end positions through the intermediary of the drive member abutting the stop members such that the air supply ports and said air exhaust ports are alternatively respectively exposed and covered by the openings so as to control the movement of the drive member. The differential in the air pressure present on both sides of the drive member within the space moves the drive member and allows the control of its movement in both wiping directions.

In addition to the above mentioned characteristics, the electrostatic liquid applicator according to the invention may further include a shroud member surrounding the stationary bell and the body portion so as to form an air slot adjacent to the spray slot to thereby provide an air flow controlling the liquid flow from the spray slot.

BRIEF DESCRIPTION OF THE DRAWINGS

The above and other advantages of the present invention will now become more readily apparent from the following detailed description, taken in conjunction with the accompanying drawings; in which.

DETAILED DESCRIPTION OF A PREFERRED EMBODIMENT

The electrostatic liquid applicator of this invention is described herein below in the embodiment of an electrostatic paint gun.

Figure 1:
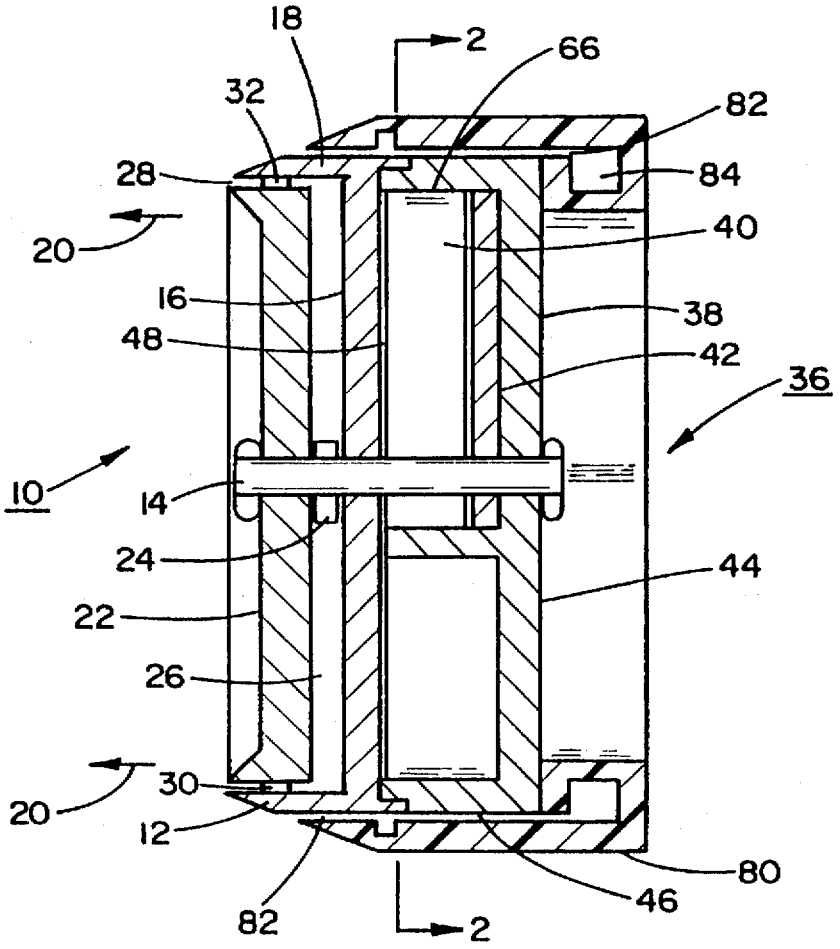
FIG. 1 illustrates a cross-sectional view through a main portion of the electrostatic liquid applicator pursuant to the invention.

FIG. 1 illustrates the main portion of the electrostatic liquid applicator in the form of a paint gun 10 in a cross-sectional view. The paint gun 10 includes a stationary bell 12 and an oscillation drive shaft 14 which extends through the stationary bell 12. The paint gun 10 may further include suitable housing structure (not shown) which is normally known in the art, which would enable the electrostatic liquid applicator to be effectively in automatic systems on stationary, reciprocater, or robotic mountings, as well as for handgun applications. The stationary bell 12 has a generally cylindrical shape and consists of a disk-like portion 16 and an annular or cylindrical sidewall 18 encompassing the outer diameter of the disk-like portion 16 which projects towards the paint spraying side 20 of the paint gun 10.

An oscillating disk 22 is fixedly mounted on the drive shaft 14 towards the end thereof forming the paint spraying side of the stationary bell 12. The oscillating disk 22 may be anchored or fastened to the oscillation drive shaft 14 by any suitable fastening means, such as a key, knurl, spine, interference fit, adhesive or the like which will facilitate transmitting the motion of the oscillation drive shaft 14 to the oscillating disk 22. As can be ascertained from FIG. 1, the oscillating disk 22 is fastened to the drive shaft 14 while positioning a spacer element 24 between the stationary bell 12 and the oscillating disk 22 so as to form a liquid plenum 26. A spray slot 28 is formed between the outer diameter of the oscillating disk 22 and the inner diameter of the annular sidewall 18 of the stationary bell 12. The paint can be supplied to the liquid plenum 26 through openings in or conduits located within the stationary bell 12 or through the drive shaft 14.

The oscillating disk 22 includes a series of spaced pads 30 extending about its outer diameter which bridge the spray slot 28 so as to contact the inner diameter of the annular sidewall 18 of the stationary bell 12. The annular sidewall 18 is provided with a complementary or mating series of pads 32 on its inner diameter so that the pads 30 of the oscillating disk 22 and those on the sidewall 18 of the stationary bell 12 are alternatively spaced. The distance between two respective adjacent pads 30, 32 on the oscillating disk 22 and on the sidewall 18 is selected to correspond with the extent of the oscillating movement of the oscillating disk 22, such that with each oscillation of the oscillating disk 22, the spray slot 28 is wiped clean of liquid or paint.

The oscillation drive shaft 14 is rotatably driven by an air-controlled drive system 36 which includes a body portion 38, a drive member 40 and a plate member 42. The body portion 38 is located at the rear side of the stationary bell 12. The oscillation drive shaft 14 extends through the body portion 38 in a similar manner as it does through the stationary bell 12. In the embodiment of FIG. 1, the stationary bell 12 and the body portion 38 are each of a basically cylindrical shape and the oscillation drive shaft 14 extends through their respective coincident center axes. The body portion 38 includes a disk-shaped member 44 and a cylindrical wall 46 extending about the outer diameter of the member 44. The cylindrical wall 46 of the body portion 38 has essentially the same diameter as the sidewall 18 of the stationary bell 12 and is fastened to the rear side of the stationary bell 12 so as to form a sealed space 48 between the rear side of the stationary bell 12 and the body portion 38. The drive member 40 is a flapper element which is attached to the drive shaft 14. The flapper element 40 projects radially into the space 48 and, in the example shown in FIG. 1, has generally the form of a flat plate constituting a sliding seal relative to the stationary bell 12, the plate member 42 and the cylindrical wall 46 of the body portion 38. The plate member 42 is located between the member 44 of the body portion 38 and the drive member 40. As shown in FIG. 1, the plate member 42 is pivotable with the oscillation drive shaft 14 as its fulcrum, and with plate member 42 possessing openings 50 and stop members 52. The stop members 52 project into the space 48 such that the plate member 42 is pivotable between two end positions through operation of the drive member 40. In essence, the drive member 40 is arranged between the two stop members 52 and reciprocates the plate member 42 by alternatingly abutting the two stop members 52, as is ascertainable from FIG. 2. The body portion 38 possesses two pressurized air supply ports **54*a*, 54*b* and two air exhaust ports 56*a*, 56*b* facing the rear side of the plate member 42. Each of the pressurized air supply ports 54*a*, 54*b* is located adjacent to respectively one of the air exhaust ports 56*a*, 56*b* and the two sets of ports 54*a*, 56*a*; 54*b*, 56*b* are located proximate the outer diameter of the disk-shaped member 44 of the body portion 38**.

Figure 2:
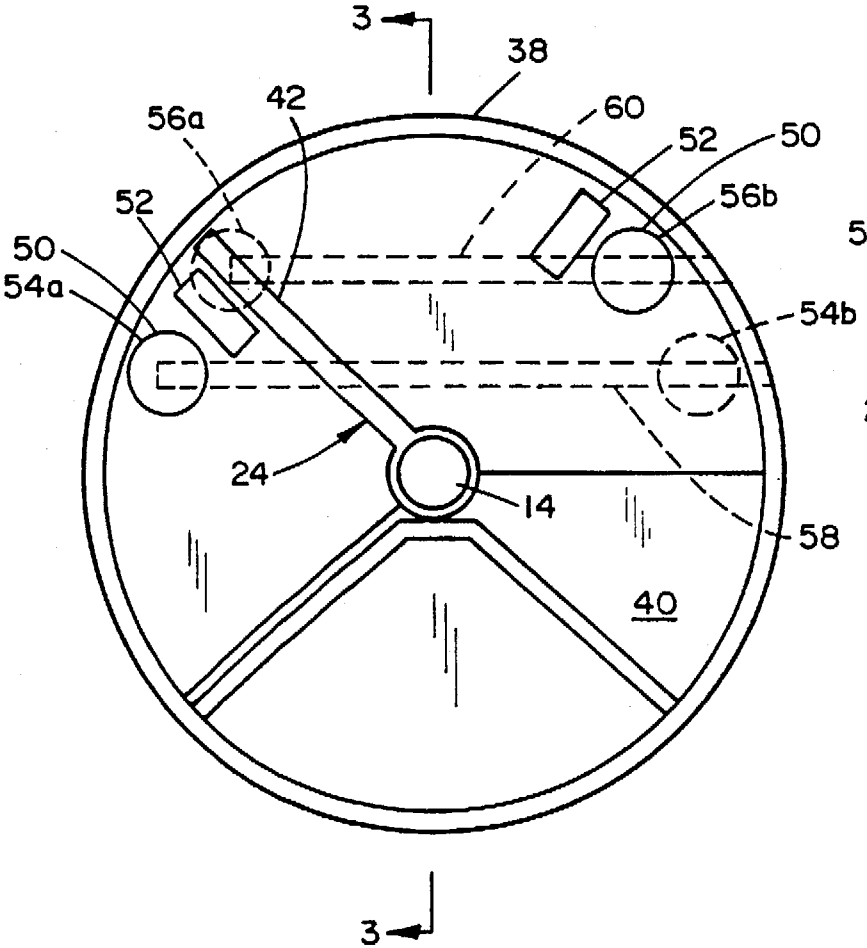
FIG. 2 illustrates a cross-sectional view of the electrostatic liquid applicator taken along line 2—2 in FIG. 1.

As shown in FIG. 2, one pressurized air supply port **54*a* and one air exhaust port 56*a* are covered by the plate member 42 as indicated by the phantom lines. The two pressurized air supply ports 54*a*, 54*b* are connected by an air supply line 58 which extends within body portion 38 and which is also indicated by phantom lines, whereas the two air exhaust ports 56*a*, 56*b* are connected by an air exhaust line 60 within the body portion 38 as also indicated by phantom lines. FIG. 2 shows the plate member 42 in one of its end positions wherein the drive member 40 abuts the one stop member 52 such that the one opening 50 in the plate member 42 aligns with the pressurized air supply port 54*a* in the body portion 38 and the other opening 50 in the plate member 42 aligns with the air exhaust port 56*b* in the body portion 38. As can be ascertained in FIG. 2, the plate member 42 in the end position thereof abuts wall 46 which extends from the member 44 of body portion 38 into the space 48. The drive member 40 divides the space 48 into two portions each at a different air pressure and is displaced responsive to the differential between these air pressures. The plate-shaped drive member 40 has its outer edge 66 form a sliding seal with the cylindrical wall 46 of the body portion 38, and with the stationary bell 12** with the two long narrowed surfaces of the plate-shape thereof.

The drive arrangement as described hereinabove may include suitable air-pressure control means 70 which is connected to the pressurized air supply ports **54*a*, 54*b* and to the air exhaust ports 56*a*, 56*b* for controlling the oscillatory movement of the drive member 40. The air-pressure control means 70 may incorporate a timer 72 and a solenoid valve system 74** for imparting predetermined intermittent oscillatory movement to the drive arrangement.

Figure 3:
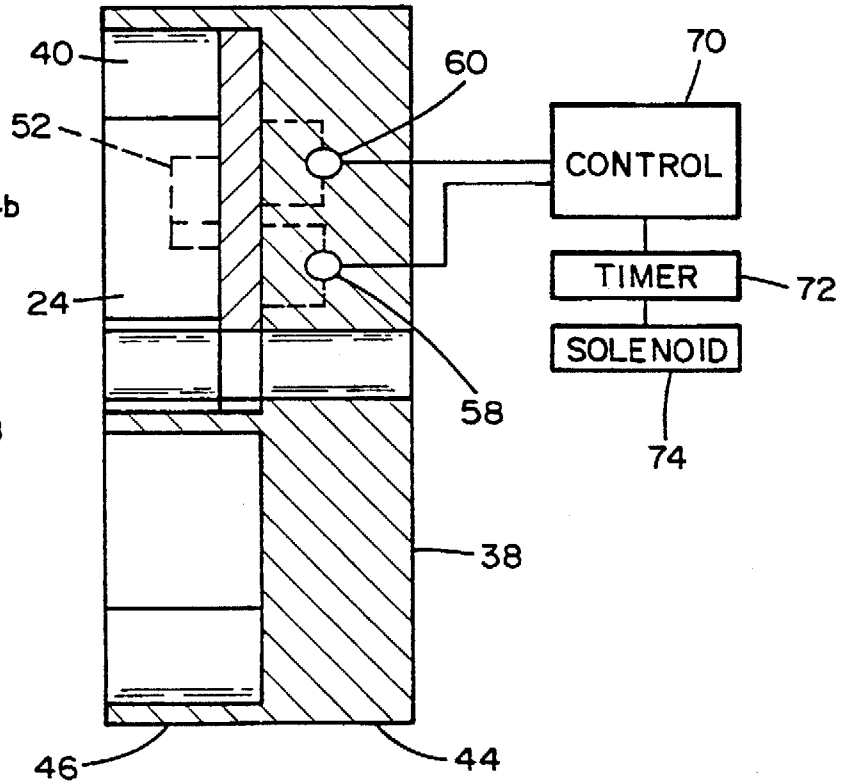
FIG. 3 illustrates a cross-sectional view of the electrostatic liquid applicator taken along line 3—3 in FIG. 2.

In FIG. 3, there is illustrated the pressurized air supply line 58 and the air exhaust line 60 within the body portion 38, and wherein the drive member 40 covers the one stop member 52, as is indicated by the phantom lines.

The presently described electrostatic liquid applicator is intended to convey the concept of a high-voltage liquid atomizer which utilizes an oscillatory flat plate to provide continuous or intermittent maintenance of a uniform flow of a liquid. The electrostatic liquid applicator of the invention can be used for the application onto diverse articles and surfaces of various kinds of liquids, for example, such as paint, and is also applicable to liquids in the form of a mist or fog.

In addition to the above described elements, the electrostatic liquid applicator may also comprise a shroud member 80, as shown in FIG. 1. The shroud member 80 encompasses the periphery of stationary bell 12 and the body portion 38, and forms an air supply slot 82 proximate the liquid spray slot 28 so as to provide an air flow controlling the flow of paint from the spray slot 28. The provision of the shroud member 80 imparts a further dimension of control to the electrostatic spray pattern. The shroud member 80 confines the electrostatic spray pattern by acting as an air knife and thereby increasing the forward propulsion of the paint droplets. This increases the penetration of the atomized liquid, for example, into areas which are normally difficult to access. The shroud member 80 produces a gentle lamellar flow of air surrounding the electrostatically charged paint or liquid droplets and directing them to the article or surface to which they are to be applied. Since the air flow is gentle in nature and peripherally extends about the paint pattern, it is effective at the applicator but is dissipated before it reaches the article, and thereby improves the efficiency in liquid or paint application.

The inner diameter of the shroud member 80 is designed to provide the slot 82 for the air flow the uniformity of which is controllable. An annular plenum 84 may be located upstream of the air supply slot 82 and may have a width which is at least 4 times the width of the air supply slot 82 so as to provide a uniform air discharge flow. The air supply may be pressure regulated to allow for a control over variations in liquid supply material.

The material of the electrostatic liquid applicator 10 must be constituted of an electrically conductive material to provide a path for the electrical current from the power supply to the sharp edges of, respectively, the disk 22 and the bell 12. A non-conductive material is recommended for the shroud member 80 of the air knife or slot 82.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An electrostatic liquid applicator, comprising a stationary bell; an oscillation drive shaft extending through said stationary bell; drive means imparting rotational movement to said drive shaft; an oscillating disk fixedly mounted on said shaft at a front side of said stationary bell and forming a spray slot and a liquid plenum with the front side of said stationary bell, said drive means including a body structure located at a rear side of said stationary bell, said body structure having a plurality of pressurized air supply ports and air exhaust ports and forming a sealed space with the rear side of said stationary bell; a drive member of said drive means projecting radially into said space and being fastened to said drive shaft between two pivotal end positions within a predetermined displacement angle; and a plate member located in said sealed space between said body structure and the rear side of said stationary bell including two openings and having stop members extending into said space, said plate member being reciprocable between said two end positions by said drive member alternatingly abutting said stop members so that said air supply ports and said air exhaust ports are alternatingly exposed and covered by said openings for controlling the oscillatory movement of said drive member.

2. An electrostatic liquid applicator according to claim 1, wherein each of said air supply ports is located adjacent to respectively one of said air exhaust ports, and said two openings are spaced apart from each other, said stop members being located between and adjacent to respectively one of said openings, whereby in each of said two end positions of said plate member one of said openings aligns with one of said air exhaust ports and the other of said openings aligns with one of said air supply ports, said drive member extending between and being movable intermediate said stop members.

3. An electrostatic liquid applicator according to claim 2, wherein said plate member is pivotable in said space with said oscillation shaft being a fulcrum and in each of the end positions of said plate means abuts a sidewall portion extending between said body structure and said stationary bell.

4. An electrostatic liquid applicator according to claim 3, wherein said drive member comprises a flat plate forming a sliding seal with said stationary bell, said body structure and said plate member.

5. An electrostatic liquid applicator according to claim 4, wherein said drive means includes air pressure control means operatively connected to said air supply ports and air exhaust ports for controlling the oscillatory movement of said drive member.

6. An electrostatic liquid applicator according to claim 5, wherein said air pressure control means comprises a timer and a solenoid valve system for imparting an intermittent oscillatory movement to said drive member.

7. An electrostatic liquid applicator according to claim 1, wherein a shroud member extends about the circumference of said stationary bell and said body structure so as to form an air slot extending about said spray slot to provide a flow of air for controlling the flow of liquid from said spray slot.

8. An electrostatic liquid applicator according to claim 7, wherein said shroud member comprises an air supply plenum located upstream of said air slot; and air pressure control means for controlling the flow of pressurized air into said air plenum, said air plenum having a width of at least about four times the width of said air slot.

9. An electrostatic liquid applicator according to claim 7, wherein said shroud member is made of an electrically non-conductive material.

10. An electrostatic liquid applicator according to claim 1, wherein said liquid comprises a paint.

* * * * *